United States Patent [19]

Miller et al.

[11] 4,177,973

[45] Dec. 11, 1979

[54] CABLE DRUM SAFETY BRAKE

[75] Inventors: Gregory C. Miller, Federal Way; Henry R. Albrecht, Seattle; C. William Clarke, Seattle; Paul L. Longthorpe, Seattle, all of Wash.

[73] Assignee: Ederer Incorporated, Seattle, Wash.

[21] Appl. No.: 883,539

[22] Filed: Mar. 6, 1978

[51] Int. Cl.[2] ..... B66D 1/48

[52] U.S. Cl. ..... 254/173 R; 188/170

[58] Field of Search ..... 254/173 R, 172, 168, 254/184, 150 FH, 183; 188/170, 171; 60/706, 711, 713; 73/158, 508, 551

[56] References Cited

U.S. PATENT DOCUMENTS

| | | | |
|---|---|---|---|
| 2,805,042 | 9/1957 | O'Leary | 254/173 R |
| 3,225,542 | 12/1965 | Hansen et al. | 254/173 R |
| 3,356,190 | 12/1967 | Prussak | 188/170 |
| 3,917,230 | 11/1975 | Barron | 254/173 R |
| 3,938,595 | 2/1976 | Swenson | 254/173 R |
| 4,023,655 | 5/1977 | Anzai et al. | 188/171 |

*Primary Examiner*—Robert J. Spar
*Assistant Examiner*—Kenneth Noland
*Attorney, Agent, or Firm*—Seed, Berry, Vernon & Baynham

[57] ABSTRACT

A system is provided for automatically clamping a cable drum in the event of mechanical failure of the drive train that connects the cable drum to its prime mover. The system monitors the mechanical continuity of the drive train by comparing the number of revolutions of the prime mover with the number of revolutions made by the cable drum in the same time interval. The system actuates a caliper disc brake mounted with the drum if a discontinuity of the drive train is detected. In the electrica system, shaft encoders are used on both the cable drum axle and prime mover shaft. The cable drum encoder is selected such that the number of pulses it produces per revolution of the cable drum is approximately equal to the number of pulses produced by prime mover shaft encoder per revolution of its shaft divided by the speed reduction ratio of the drive train. The counters in the comparator are periodically reset to prevent the slight difference in the number of pulses produced by the encoders during normal operations from falsely indicating a drive train discontinuity. In the mechanical system, the prime mover shaft and cable drum axle may be connected to a mechanical phase sensing switch through respective rotation transmitting cables in order to determine if the cable drum and prime mover are rotating at the drive train speed reduction ratio.

8 Claims, 8 Drawing Figures

CABLE DRUM SAFETY BRAKE

BACKGROUND OF THE INVENTION

1. Field of the Invention

This invention relates to safety mechanisms for cable drums, and more particularly, to a system for indicating drive train failure between a prime mover and cable drum by comparing the revolutions of the prime mover to that of the cable drum.

2. Description of the Prior Art

Mechanical systems such as winches and cranes utilizing flexible cables wrapped around cylindrical cable drums are well known and in common use. Such cable drums are generally driven by a high speed prime mover, such as an electric drive motor, through a speed reducing drive train composed primarily of interlocking gears. Although these drive trains are extremely reliable, the consequences of a drive train failure are extremely severe since a failure could allow a heavy load to fall freely. Consequently, it is important to be able to detect such drive train failure and automatically terminate cable drum rotation before the load connected to the cable has fallen sufficiently to build up significant momentum. Furthermore, the operation of the safety system should not depend upon other systems, such as the mechanism's electrical system, since a drive train failure may also be accompanied by an electrical failure.

SUMMARY OF THE INVENTION

It is an object of the invention to provide a cable drum safety brake for automatically preventing rotation of a cable drum responsive to mechanical failure in a drive train connecting the cable drum to a prime mover.

It is another object of the invention to provide a cable drum safety brake having an adjustable threshold for actuating the braking system to account for gear lash in the drive train without falsely indicating a drive train failure.

It is still another object of the invention to provide a cable drum safety brake which is inherently failsafe insofar as operation of the system does not depend upon receiving energy from an external power source.

These and other objects of the invention are provided by sensing means which measure the revolutions of both the prime mover and the cable drum. The relationship between the rotation of the prime mover and the rotation of the cable drum corresponds to the speed reduction ratio of the drive train in normal operation. A detection circuit examines the rotation of the prime mover and cable drum for a deviation from this relationship and actuates a cable drum braking mechanism in response thereto. The cable drum safety braking system may be implemented by an electrical system utilizing shaft encoders as rotation sensors, with the output pulses per revolution of the encoders selected so that the frequency of the pulses from the encoders is approximately equal during normal operating conditions. The output pulses from the encoders are connected to respective counters, and the outputs of the counters are compared for an indication of mechanical failure in the drive train once the outputs of the counters are approximately equal during normal operating conditions. Alternatively, a mechanical system may be employed utilizing a reduction transmission having a reduction ratio equal to the speed reduction ratio of the drive train. The input shaft of the transmission is connected to the prime mover so that the output shaft of the transmission rotates the same amount as the cable drum. The cable drum and the output shaft of the transmission are coupled to a mechanical phase sensing switch which actuates the braking mechanism when the rotational position of the cable drum deviates a predetermined amount from the rotational position of the transmission output shaft during a mechanical failure of the drive train. A braking mechanism which is spring set or gravity and maintained in its released condition by the safety braking system is utilized with both the mechanical and electrical detection systems so that actuation of the braking mechanism does not depend upon the receipt of energy from an external power source.

DETAILED DESCRIPTION OF THE PREFERRED EMBODIMENTS

Figure 1:
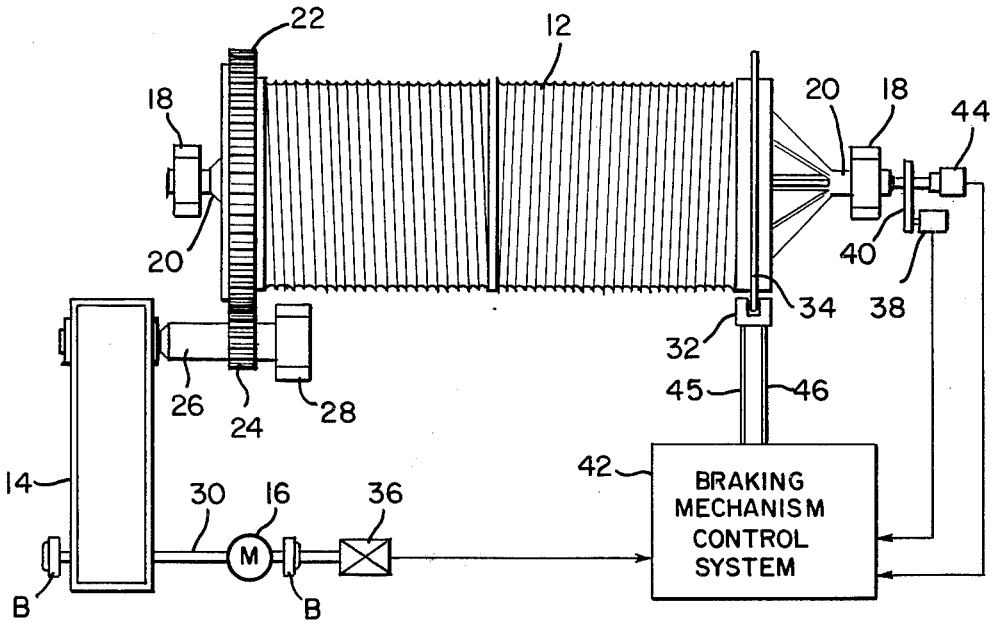
FIG. 1 is an overall schematic of the electrical drive train failure detection system and safety brake including the cable drum connected to a prime mover through a speed reducing drive train.

The electrical drive train failure detector and safety brake, as illustrated in FIG. 1, is adapted to prevent rotation of a cable drum 12 in the event of mechanical failure in a drive train, such as transmission 14 connecting the cable drum 12, to a prime mover, such as an electrical motor 16. The cable drum 12 is rotatably mounted on a fixed mounting surface (not shown) by bearings 18 of conventional variety engaging a cable drum axle 20. A relatively large pinion gear 22 mounted at one end of the drum 12 engages a smaller pinion gear 24 mounted on the output shaft 26 of the transmission 14. The end of the output shaft 26 is rotatably mounted on a fixed surface by a bearing 28 of conventional variety. The motor 16 is connected to an input shaft 30 of the transmission 14 so that as the motor 16 rotates, the drum 12 rotates through the gears 22, 24. In operation the motor 16 rotates in either direction depending upon the desired direction of rotation of the cable drum 12. The transmission 14 is generally a speed reduction device so that the input shaft 30 rotates a large number of revolutions for each revolution of the drum 12. The system as described to this point is well known and conventionally used for a variety of purposes including the actuating mechanism for cable hoists.

The safety braking system is adapted to prevent rotation of the cable drum 12 in response to a failure in the mechanical drive train connecting the cable drum 12 to the motor 16. Although such failures generally occur in the transmission 14, the term "drive train" as used herein includes all of the mechanical coupling devices between the drum 12 and motor 16 including the input shaft 30, the transmission 14, the output shaft 26 and the pinion gears 22, 24. The drum 12 is prevented from rotating in response to a mechanical failure by actuating a caliper disc braking mechanism 32 so that it frictionally engages a disc 34 mounted on the drum 12 and rotating therewith. Briefly, the system functions by measuring the rotation of the motor 16 with a conventional encoder 36 which produces a fixed number of output pulses for each revolution of the encoder shaft. Simularly, the rotation of the cable drum 12 is measured by an encoder 38 coupled to the cable drum axle 20 by a drive belt 40. The number of pulses per revolution produced by the motor encoder 36 relative to the number of pulses produced per revolution by the cable drum encoder 38 is selected so that the frequency of the pulses from both encoders 36, 38 are approximately equal during normal operating conditions. Thus, for example, where the rotation of the motor 16 is 500 times the rotation of the cable drum 12, the cable drum encoder 38 produces 500 pulses for each revolution while the motor encoder 36 produces only one pulse per revolution. Consequently, the drive motor encoder 36 produces one pulse for each pulse produced by the cable drum encoder 38. The conditioned outputs of the encoders 36, 38 are connected to a brake mechanism control system 42 which generates appropriate pressure signals on pneumatic lines 45, 46 to actuate the braking mechanism 32 when the total number of the pulses from the drive motor encoder 16 deviates by a sufficient amount from the total number of the pulses produced by the cable drum encoder 38.

The cable drum safety brake shown in FIG. 1 is also capable of preventing rotation of the cable drum 12 responsive to other failure modes besides a mechanical failure in the drive train between the drum 12 and motor 16. For example, a failure in external braking systems (not shown) for selectively preventing rotation of the motor 16 or drum 12 may allow the drum 12 and motor 16 to freely rotate. Since the frequency of the pulses from both encoders 36, 38 are equal during this condition the previously described system would not respond to this failure mode. However, an overspeed switch 44 is coupled to the cable drum axle 20 for producing an electrical indication when the rotational velocity of the cable drum 12 exceeds a predetermined value. The output of the overspeed switch 44 is connected to the braking mechanism control system 42 so that the control system 42 can actuate the braking mechanism 32 in an overspeed condition. The overspeed switch 44 is a conventional device sold by the Industrial Control Division of Harvey Hubbell, Inc. of Madison, Ohio. Although the specific model of overspeed switch utilized will, of course, depend upon the specific application, the model 2220 which opens an electrical contact when the rotational velocity of its input shaft exceeds a value adjustable between 5 and 50 revolutions per minute has been advantageously used in one application.

Figure 2:
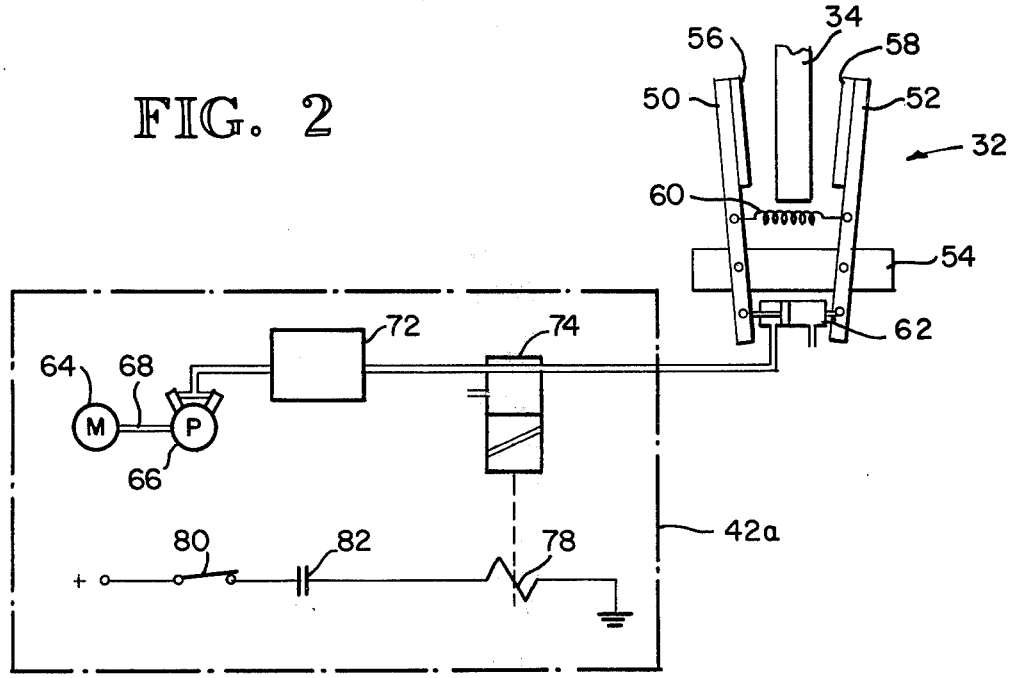
FIG. 2 is a schematic of one portion of the brake mechanism control system including the pneumatic system for actuating the caliper disc brake to prevent rotation of the cable drum.

A portion of the braking mechanism control system including the system for actuating the braking mechanism 32 is illustrated in FIG. 2. An illustrative brake mechanism 32 includes a pair of caliper arms 50, 52 pivotally mounted to a frame 54 and positioned to straddle the braking disc 34. Layers of frictional braking material 56, 58 are secured to the opposed faces of the caliper arms 50, 52 and are spring set against opposite faces of the disc 34 thereby preventing rotation of the drum 12. The arms 50, 52 are actuated away from their braking position by a pneumatic actuator 62 connected between the arms 50, 52 on the opposite side of the frame 54 from the tension spring 60.

The pneumatic system is powered by a prime mover 64, such as an electric motor, which drives a conventional compressor pump 66 through a shaft 68. The pump 66 delivers pressurized air to a tank 72. The air pressure from the tank 72 is applied to a conventional solenoid valve 74. When the solenoid valve 74 is in its energized position as illustrated in FIG. 2 the lefthand side of the piston in actuator 62 is pressurized while the right-hand side of the piston is vented. Consequently, the arms 50, 52 adjacent the actuator 62 are drawn toward each other thereby removing the frictional braking surfaces 56, 58 from the disc 34 and allowing the drum 12 to rotate. When the coil 78 of the solenoid 74 is de-energized the lefthand side of the actuator 62 is vented thereby applying the braking mechanism 32 and preventing the drum 12 from rotating. The solenoid coil 78 is connected in series with an electrical contact 80 of the overspeed switch 44 and a normally open relay contact 82 so that the solenoid 74 is energized and the braking mechanism 32 is disengaged to allow the drum 12 to rotate as long as the overspeed contact 80 and the relay contact 82 are closed.

Figure 3:
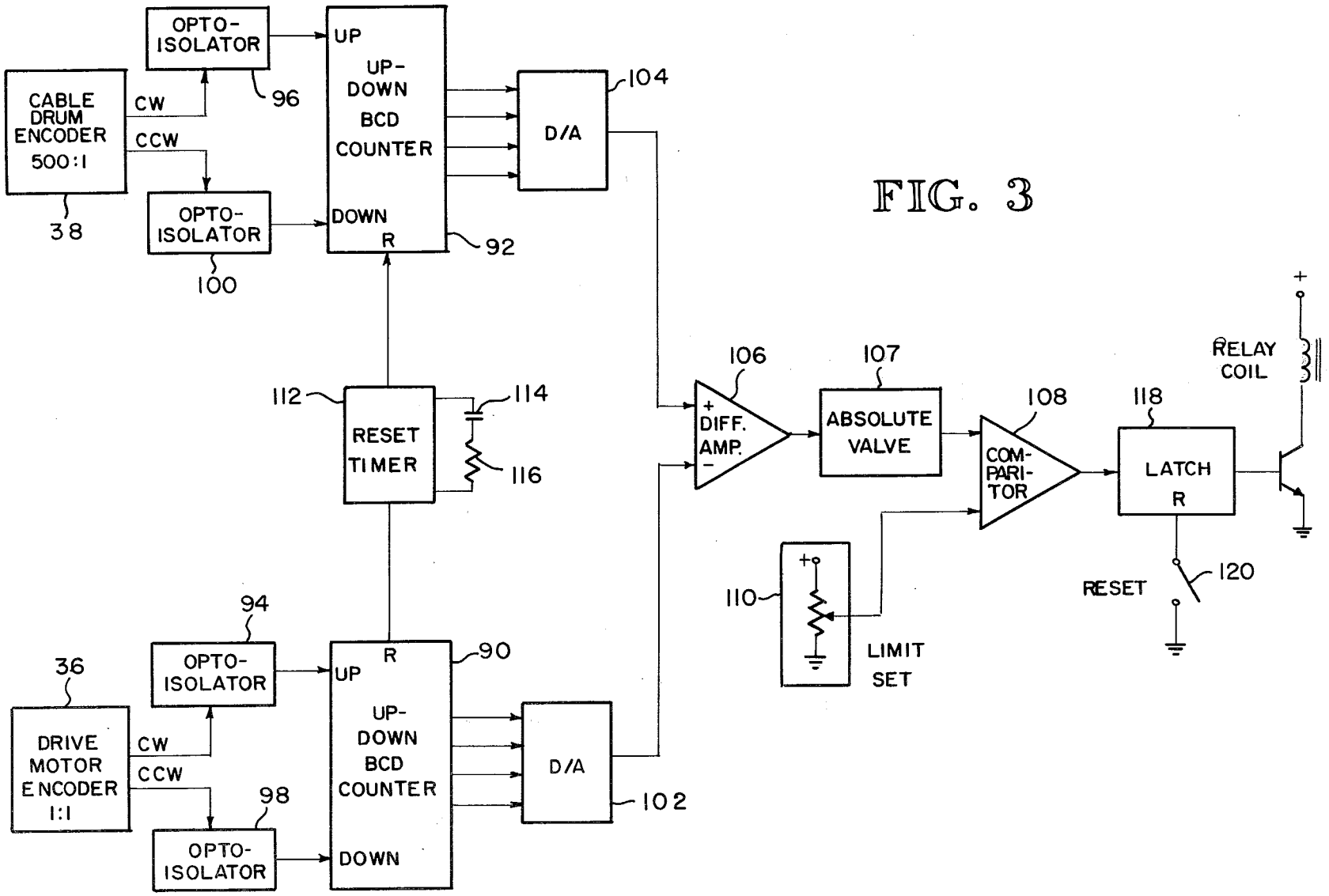
FIG. 3 is a schematic of another portion of the brake mechanism control system including the electrical circuits for determining whether a mechanical failure has occurred in the drive train.

The system for comparing the rotation of the motor 16 and cable drum 12 is illustrated in FIG. 3. Both the cable drum encoder 38 and the drive motor encoder 36 have two outputs. Pulses are produced on one output when the shafts of the encoders 36, 38 are rotating in a clockwise direction, and pulses are produced on the other output when the shafts of the encoders 36, 38 are rotating in a counter-clockwise direction. The encoders 36, 38 are commercially available model 715 encoders sold by Encoder Products Co. of Sand Point, Idaho. The clockwise outputs of both encoders 36, 38 are connected to the "UP" inputs of up-down binary counters 90, 92 through opto-isolators 94, 96, respectively. Similarly, the counter-clockwise outputs of the encoders 36, 38 are connected to the "DOWN" inputs of the counters 90, 92 through opto-isolators 98, 100. The counters 90, 92 are standard articles of commerce such as model 74C193 counter sold by Texas Instruments, Inc. (hereinafter referred to as "T. I."), Motorola, Inc. and National Semiconductor, Inc. (hereinafter "Nat'l."). Similarly, the opto-isolators 94-100 are available from Motorola and T.I. and designated model ILCT-6. Under normal operating conditions both counters 90, 92 are either counting up at the same rate or down at the same rate so that the outputs of both counters 90, 92 are equal. The outputs of the counters 90, 92 are received by a matched pair of Binary Magnitude Comparators 104, 102 which each will produce a "low" output whenever the binary information in each line is equal. By changing the internal connection on the comparators, the system sensitivity is set. The sensitivity adjustment allows operation when the actual mechanical speed ratio is not a ratio which can be exactly electrically matched. The sensitivity adjustment, or offset, also allows for the mechanical slack take-up, lash, without a false trip. The binary magnitude comparators are commercially available integrated circuits such as Nat'l. MM74C85 4 bit units cascaded.

The counters 90, 92 are periodically reset by a reset timer 112 having a reset frequency determined by timing capacitor 114 and resistor 116. Since both counters 90, 92 are periodically reset to zero, the outputs of the counters 90, 92 are proportional to the amount the shafts of the drive motor encoder 36 and cable drum encoder 38, respectively, have rotated since the last reset. However, the outputs of the counters 90, 92 are also representative of the average rotational velocities of the motor 16 and drum 12, respectively, during the counting interval, since a higher rotational velocity produces a larger number of pulses from the respective encoder in a given period of time. Hence, the output of the binary magnitude comparators 102, 104 will be "low" until the predetermined offset is exceeded between counter reset points. The typical offset would be four counts, which at 1000 r.p.m. on the prime mover shaft could occur in 0.24 seconds on this system if the cable drum shaft stopped moving. Once the offset is exceeded, the output of each comparator will go "high'-'feeding a signal to its respective output driver latch circuit 107, 108. The output driver/latch circuits utilize Nat'l. MM 74C175 latch integrated circuits. The comparator "high" output will drive the output driver "low," de-energizing the relay 120, and the output drivers will latch in the "low" state and energize the fault indicators 118, 119. Reset is accomplished by removing power from the latch circuit and resetting the ratio monitoring system. The relay 120, when de-energized, will stop the prime mover, de-energize the solenoid coil 78, and allow the cable drum brake 32 to set, thus stopping the load.

The static system check circuit is used to prove that all electronic components, with the exception of the encoders, are functioning properly. While the drive is at rest, the switch 12 is set to either up or down, and the two gang potentiometer 121A, B is moved from its center position to a value which causes the dual square wave generator 122 to simulate one encoder counting faster than the other. Once the offset is exceeded both fault indicator 118, 199 light are energized the normal indicator light 110 is de-energized. The system is then checked in the opposite direction. These checks prove that both of the redundant paths are functioning properly. The switch is then returned to the "off" position to return the drive train detector to operation. This check verifies that any single component failure would only cause a safe shutdown of the machinery.

Not shown is the reset circuitry which resets all counters to zero and holds off the latch circuitry for approximately ½ second on initial erergization of the system.

Figure 4:
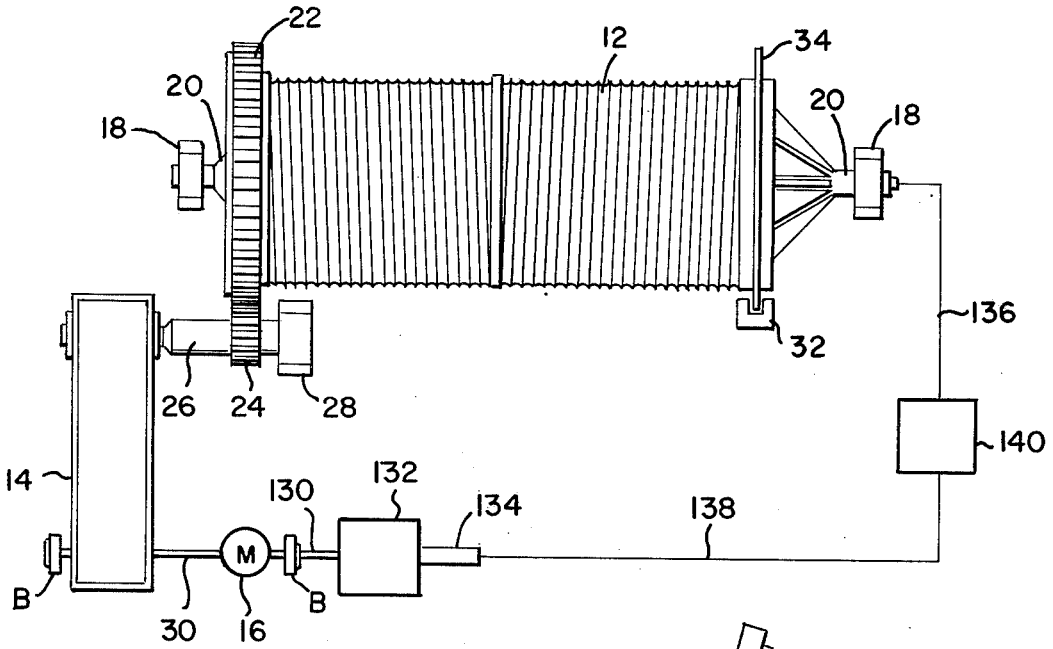
FIG. 4 is an overall schematic of a purely mechanical cable drum safety brake.
Figure 5:
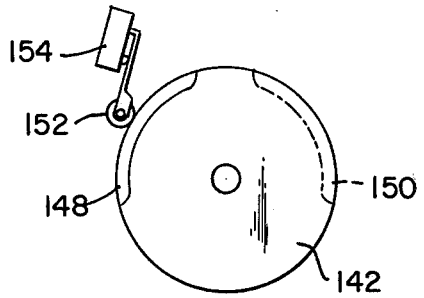
FIG. 5 is an illustration of a mechanical phase switch utilized in the mechanical system of FIG. 4.
Figure 5B:
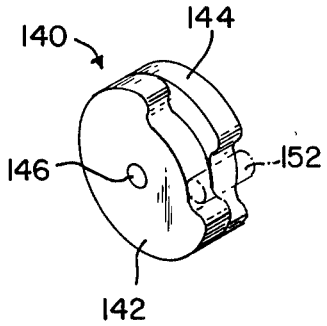
FIGS. 5A, 5B and 5C are side, isometric and front or axial views, respectively, of the mechanical phase switch shown in FIG. 5.
Figure 5A:
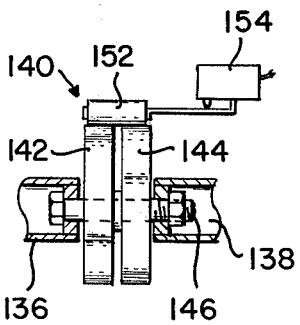
Figure 5C:
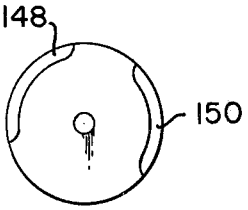

A mechanical drive train failure detector cable drum safety brake as illustrated in FIG. 4 utilizes the same concept as the system of FIG. 1. The shaft of the motor 16 is connected to the input shaft 130 of a transmission 132 having a speed reduction ratio which is identical to the speed reduction ratio of the drive train between the cable drum 12 and motor 16. Cnosequently, the output shaft 134 of the transmission 132 rotates the same amount as the cable drum 12 during normal operating conditions. The axle 20 of the cable drum 12 and the output shaft 134 of the transmission 132 are connected to respective rotation transmitting cables 136, 138 such as those conventionally used as speedometer cables. The opposite ends of the cables 136, 138 drive a differential phase switch 140 illustrated in detail in FIG. 5. The phase switch 140 includes a pair of discs 142, 144 rotatably mounted on a shaft 146 and connected to respective cables, 136, 138 so that the disc 142 rotates with cable 136 and the disc 144 rotates with cable 138. The discs 142, 144 have formed on their outer peripheries notches 148, 150, respectively, which are normally positioned out of alignment as best illustrated in FIG. 5C during normal operating conditions. A cam following 152 connected to a normally closed switch contact 154 is resiliently biased against the peripheries of the discs 142, 144. As long as the notches 148, 150 do not align themselves with each other the cam follower 152 is positioned at the outer periphery of the discs 142, 144 thereby maintaining the contact 154 in its closed position. However, in response to a mechanical failure of the drive train the output shaft 134 of the transmission 132 rotates at a different rate than the axle 20 of the cable drum 12 thereby causing the discs 142, 144 to rotate at different rates so that the notches 148, 150 are periodically placed in alignment with each other as illustrated in FIG. 5B. When the aligned notches 148, 150 pass beneath the cam follower 152 the follower is permitted to move radially inward thereby opening the normally closed contacts of switch 154. The contacts of the switch 154 are in series with the coil 78 of solenoid 74 (FIG. 2) in place of the contact 82 in the electrical system so that the braking mechanism is applied to prevent rotation of the cable drum 12.

While the preferred embodiments of the invention have been illustrated and described, variations will be apparent to those skilled in the art without departing from the principles herein, i.e., hydraulically releasing the brake. While the disclosed embodiments are very advantageous, it is recognized that other forms of detection of a malfunction are possible. For example, other detection systems such as cable drum overspeed, or a deviation between commanded-speed or -direction and actual -speed or -direction may be used in some instances.

We claim:

1. A safety system for preventing rotation of a cable drum in response to failure or overload condition of a drive train having a speed reduction ratio, said cable drum being driven by a prime mover through said drive train, said safety system, comprising:

sensing means having an output for measuring the rotation of said prime mover with respect to the rotation of said cable drum;

braking means for preventing rotation of said cable drum responsive to a drive train failure or overload indication; and detection means receiving the output of said sensing means for generating said drive train failure or overload indication when said condition occurs when the rotation of said prime mover relative to the rotation of said cable drum deviates from a predetermined relationship which corresponds to the speed reduction ratio of said drive train.

2. The safety system of claim 1 wherein said braking means comprise:

a brake disc mounted with said cable drum such that said brake disc and cable drum rotate as a unit;

a pair of brake pads positioned on opposite sides of said brake disc, said pads having frictional braking surfaces facing toward each other adapted to frictionally engage said brake disc when said pads move toward each other;

means for resiliently biasing said pads toward each other to cause said braking surfaces to frictionally engage said brake disc; and actuating means for moving said pads away from each other to remove said braking surfaces from said cable drum, said acutating means being energized in the absence of said drive train failure or overload indication and being de-energized in the presence of said drive train failure or overload indication such that said safety system prevents rotation of said cable drum when said actuating means is in its de-energized condition.

3. The system of claim 1 wherein said sensing means include first and second shaft encoder means rotating with said prime mover and said cable drum, respectively, for generating predetermined numbers of pulses for each shaft encoder revolution, and wherein said detection means compromise first and second counting means for counting the number of pulses generated by said first and second shaft encoder means, respectively, and comparator means for comparing the output of said first counting means with the output of said second counting means and for producing said failure or overload indication responsive to a predetermined difference in said outputs of said first and second counting means.

4. The system of claim 3 wherein the ratio between the number of pulses produced for each revolution of said first shaft encoder means to the number of pulses produced for each revolution of said second shaft encoder means is equal to the speed reduction ratio of said drive train such that the outputs of said first and second counting means are approximately equal when said cable drum is rotating with said prime mover.

5. The system of claim 1 wherein said sensing means and said detection means comprise:

mechanical phase sensing means for producing said drive train failure or overload indication when the rotational position of a first input shaft bears a perdetermined relation to a second input shaft;

first rotation transmitting means connecting said prime mover to said first input shaft;

second rotation transmitting means connecting said cable drum to said second input shaft, said second rotation transmitting means rotating said second input shaft the same as said first input shaft under normal operating conditions.

6. The system of claim 5 wherein said mechanical phase sensing means comprise:

first and second rotatably mounted discs connnected to said first and second input shafts, respectively, said discs being positioned fact-to-face on a common axis of rotation, each of said discs having a notch formed on its outer periphery;

A cam follower resiliently biased against the peripheries of said first and second discs, said cam follower being adapted for insertion in said notches when said notches overlap each other; and position sensing means for producing an indication when said cam follower moves radially toward the center of said discs thereby indicating that said cable drum and said prime movers are not rotating at the predetermined relationship.

7. The system of claim 5 wherein said first rotation transmitting means includes a speed reducing transmission having an input shaft connected to said drive motor and an output shaft rotating the first input shaft of said mechanical phase sensing means, said speed reducing transmission having a speed reduction ratio equal to the speed reduction ratio of said drive train thereby allowing the second input shaft of said mechanical phase sensing means to be directly coupled to said cable drum.

8. A method of preventing rotation of a cable drum responsive to failure of a drive train having a speed reduction ratio, said cable drum being driven by a prime mover through said drive train, said method comprising the steps of:

measuring the rotation of said prime mover;

measuring the rotation of said cable drum;

comparing the rotation of said prime mover to the rotation of said cable drum; and preventing rotation of said cable drum when the rotation of said prime mover relative to the rotation of said cable drum deviates from a predetermined relationship corresponding to the speed reduction ratio of said drive train.

* * * * *